US012396537B1

(12) United States Patent
Barkley

(10) Patent No.: US 12,396,537 B1
(45) Date of Patent: Aug. 26, 2025

(54) SEALED TEXTILE ARTICLES CONTAINING PRESSED FLOWERS AND PROCESSES FOR MAKING SUCH ARTICLES

(71) Applicant: Savannah Marie Barkley, West Warwick, RI (US)

(72) Inventor: Savannah Marie Barkley, West Warwick, RI (US)

( * ) Notice: Subject to any disclaimer, the term of this patent is extended or adjusted under 35 U.S.C. 154(b) by 0 days.

(21) Appl. No.: 18/896,118

(22) Filed: Sep. 25, 2024

(51) Int. Cl.

| | |
|---|---|
| ***A45C 13/08*** | (2006.01) |
| ***A45C 3/00*** | (2006.01) |
| ***A45C 3/06*** | (2006.01) |
| ***A45C 13/10*** | (2006.01) |

(52) U.S. Cl.
CPC ..... *A45C 13/08* (2013.01); *A45C 3/001* (2013.01); *A45C 3/06* (2013.01); *A45C 13/103* (2013.01)

(58) Field of Classification Search
CPC ..... A45C 3/001; A45C 3/06; B29C 65/00; B29C 65/02; B29C 65/48; B29C 65/56; B29C 65/62; B29C 65/72
USPC .... 156/60, 61, 63, 70, 91, 92, 93, 182, 196, 156/221, 222, 227, 297, 299, 300, 308.2, 156/309.6, 57; 428/13, 24, 192, 542.2, 428/542.4, 66.5, 22, 14; 427/4
See application file for complete search history.

(56) References Cited

U.S. PATENT DOCUMENTS

| | | | | |
|---|---|---|---|---|
| 4,885,037 | A * | 12/1989 | Ohkubo | B44C 5/005 428/22 |
| 5,935,355 | A * | 8/1999 | Lai | B44C 5/06 264/279.1 |
| 6,159,582 | A * | 12/2000 | Hsu | B44C 7/00 428/326 |
| 6,417,119 | B1 * | 7/2002 | Roberson | B44C 1/105 428/354 |
| 6,683,520 | B1 * | 1/2004 | Sakai | B44C 5/06 428/22 |
| 6,818,265 | B2 * | 11/2004 | Wang | B44C 1/105 428/40.1 |
| 2003/0079818 | A1 * | 5/2003 | Dallosta | B44F 1/066 156/57 |
| 2005/0103420 | A1 * | 5/2005 | Chen | A41D 27/08 156/57 |

* cited by examiner

*Primary Examiner* — Philip C Tucker
*Assistant Examiner* — Brian R Slawski
(74) *Attorney, Agent, or Firm* — Feeney IP Law; Daniel W. Sullivan; Alan F. Feeney

(57) ABSTRACT

Sealed textile articles containing dried, pressed flowers and processes for making such sealed textiles are provided. The dried, pressed flowers are sealed in transparent layers of the article. The flowers are clearly visible through the transparent layers. A wide variety of sealed textile articles can be made such as, for example, wearable accessories, handbags, purses, clutch bags, and wallets. The flowers are sealed in a transparent layer of the wearable accessory, handbag or other sealed textile article so that the flowers are clearly visible.

15 Claims, 7 Drawing Sheets

SEALED TEXTILE ARTICLES CONTAINING PRESSED FLOWERS AND PROCESSES FOR MAKING SUCH ARTICLES

BACKGROUND OF THE INVENTION

Field of the Invention

The present invention relates generally to sealed textile articles containing dried, pressed flowers and to processes for making such sealed textiles. A wide variety of textile articles can be made such as, for example, wearable accessories, handbags, purses, clutch bags, and wallets. The flowers are sealed in a transparent sheet of the wearable accessory, handbag or other article so that the flowers are clearly visible.

Brief Review of the Related Art

In recent years, products having decorative pressed flowers have become more popular. For example, pressed flowers have been pasted to paper, glass, metals, and plastic materials to make products such as greeting cards, stationery, post cards, photographs, and the like. Different techniques have been used for drying flowers and pressing them to a substrate.

For example, Noguchi, Makoto (Sakai) EP Patent 0,487,736 discloses a method of making a sealed ornament containing a dried and pressed flower, comprising the steps of: a) selecting and/or covering a base to provide a first sealing layer; b0 arranging a dried and pressed flower on the first sealing layer; c) overlaying the dried and pressed flower with a second sealing layer made of a flexible film having a melting point below 120° C.; and d) reducing the air pressure about the dried and pressed flower.

Sakai, Tsuyoshi (Sakai), U.S. Patent 63/222,862 discloses an object containing pressed flowers sealed therein which is composed of a base layer, an intermediate layer of molten resin in which is sealed a pressed flower, and a surface layer of transparent film. The three layers are integrally laminated on top of each other. The intermediate layer is formed by heat-pressing under reduced pressure from a meltable porous plastic film. The molten plastic adheres closely to the pressed flower to seal it and also fixes the flower to both the base layer and surface layer of the transparent film.

Sakai, Mieko (Doppel Co.) EP Patent 1,024,029 discloses a magnet having a sheet with a pressed dry flower sealed therein. The sheet is disposed on one side of the substrate. An intermediate layer having the pressed dry flower is sealed therein by a molten resin and a transparent film surface layer is laminated and integrated on one side of the substrate. The intermediate layer is formed by pressurizing a melting resin film under heat in a vacuum and adhering the molten resin to the pressed flower.

However, some conventional products containing pressed flowers have some drawbacks. For example, one problem is that the pressed flowers might be incompletely sealed so that air and moisture can surround the flowers. This can lead to the flowers breaking and fading over relatively short periods of time. It would be desirable to have a manufacturing process where the flowers could be pressed and sealed to maintain their natural colors, vibrancy, gloss, and overall aesthetics. It would be particularly desirable to have textile articles such as, for example, wearable accessories, handbags, purses, clutch bags, and wallets. with transparent panels containing pressed flowers.

The present invention provides such a manufacturing process and the resulting sealed textile articles. The sealed textile articles contain dry, pressed flowers that are sealed in transparent layers of the article, so the flowers are clearly visible. Other advantages, features, and benefits of the present invention are described further below.

SUMMARY OF THE INVENTION

The present invention relates generally to sealed textile articles containing pressed flowers and processes for making such sealed textiles. The process includes the steps of: i) selecting at least one flower that will be pressed; ii) pressing the selected flower; iii) placing the pressed flower on a front surface of a first transparent plastic film layer; iv) laminating the first plastic film layer to a second transparent plastic film layer to form a front transparent plastic sheet, wherein the at least one pressed flower is disposed between the first and second transparent film layers of the plastic sheet; v) repeating steps i) through iv) to form a rear transparent plastic sheet; vi) sewing the front and rear transparent plastic sheets together to form a sealed textile article, wherein a stitch line is formed on an exterior surface of the article; and vi) turning the sealed textile article so that the stitch line is located on the inside of the article and is not visible on the exterior surface.

A wide variety of textile articles can be made such as, for example, wearable accessories, handbags, purses, clutch bags, and wallets. The flowers are sealed in a transparent layer of the wearable accessory, handbag or other article so that the flowers are clearly visible. In one example, the sealed textile article is a handbag, wherein the front and rear transparent plastic sheets define an interior compartment, and the interior compartment has a top opening. The top opening can be closed by any suitable mechanism including, for example, a releasably attachable flap or a zipper.

A single flower or multiple flowers can be pressed in the sealed textile. In one embodiment, multiple flowers are pressed, and the flowers have a moisture content in the range of about 5 to about 10 percent. The pressed flowers can be coated with an ultraviolet (UV) light-resistant coating. Also, the pressed flowers can be placed on the first vinyl film sheet with gold leaf. Different steps can be used in the process of the invention. For example, the first vinyl film sheet can be laminated to the second vinyl film sheet under pressure at a temperature in the range of about 280° to about 310° F. In another example, the thickness of the laminated first and second vinyl film sheets can be about 2 mm. Preferably, the stitch line is formed in a zig-zag pattern. Also, different materials can be used to make the film. For example, the first and second vinyl film sheets can be made from a material selected from the group consisting of polyethylene, ethylene-ethyl acrylate copolymer, ethylene-vinyl acetate copolymer, ethylene-acrylic acid copolymer, and ethylene-methacrylic acid copolymer; and combinations thereof.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
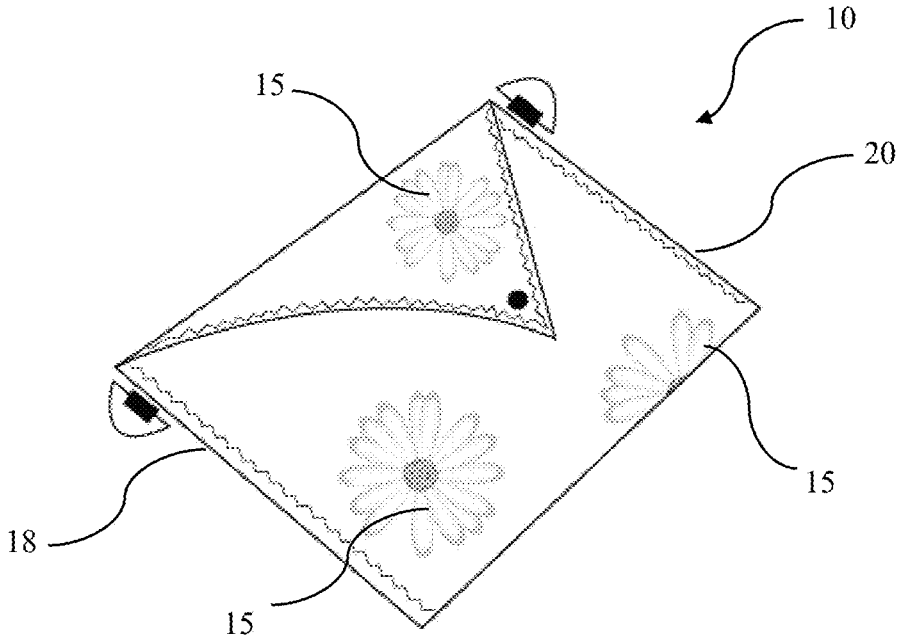
FIG. 1 is a perspective view of one embodiment of a transparent sealed textile article made in accordance with the present invention.
Figure 2:
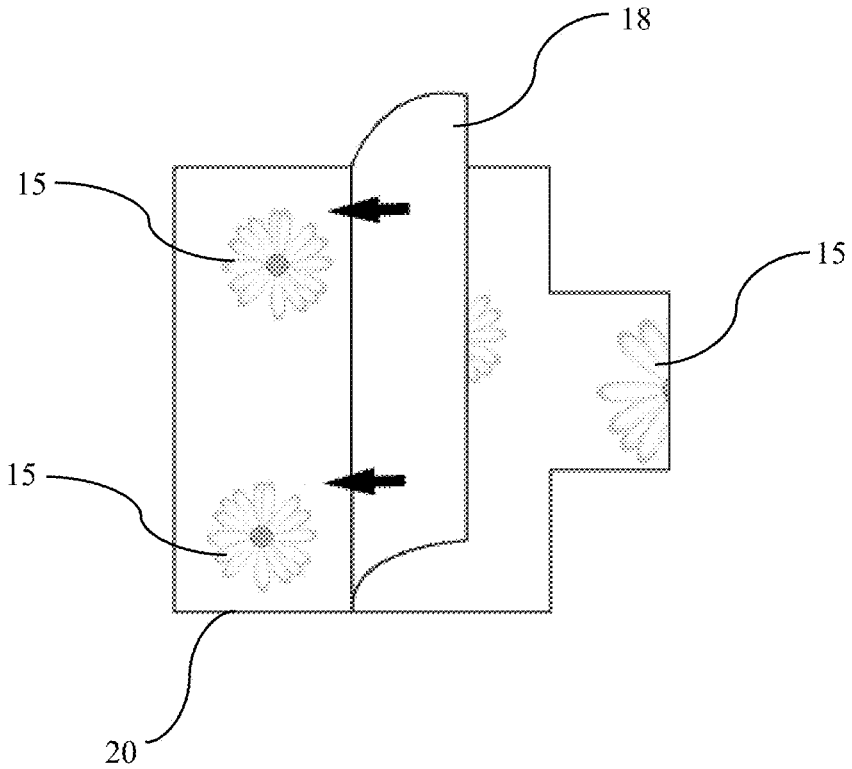
FIG. 2 is a top view of one embodiment of a transparent sealed textile article being made in accordance with the present invention, wherein an upper transparent film layer is shown being applied over a lower transparent film layer.

The present invention relates generally to sealed textile articles containing dry, pressed flowers and processes for making such sealed textiles. The dried, pressed flowers are sealed in transparent layers of the article. The flowers are clearly visible through the transparent layers. A wide variety of sealed textile articles can be made such as, for example, wearable accessories and handbags. By the term, "handbag", as used herein, it is meant a bag of any size commonly used for holding money, personal grooming items, keys, cosmetics, small items, and the like carried especially by women, including, but not limited to, purses, clutch bags, and wallets. The handbag can have single or multiple compartments. In one embodiment, the handbag has a carrying handle. In another embodiment, the handbag has no carrying handles. In a further embodiment, the handbag has shoulder straps for carrying the bag. In yet another embodiment, the handbag has no shoulder straps. For example, clutches are small purses that can be carried in the hand and do not have handles or straps. Clutches are often used for holding personal grooming items and cosmetics, Sealed Textile Article Assembly Referring to the Figures, where like reference numerals are used to designate like elements, and particularly FIG. 1, one embodiment of a sealed textile article of the present invention is shown. The sealed textile article (10) contains dried, pressed flowers (15) positioned between a first (upper) transparent film layer (18) and a second (lower) transparent film layer (20). Referring to FIG. 2, the upper transparent film layer (18) is shown being applied over the lower transparent film layer (20). The sealed textile article can be formed by pressing, under heat and pressure, a first plastic transparent film to form a gently fused first film layer (18). A gently fused second transparent film layer (20) is formed by pressing, under heat and pressure, a second plastic film. Dry flowers (15) are arranged in distinct positions between film layers (18, 20). The heated, gently fused first and second film layers (18, 20) seal the pressed flowers (15) and fix the pressed flowers in position.

In one example of the invention, a handbag can be made. For example, the handbag can comprise: a) a front transparent panel; the front transparent panel comprising first and second film layers, the first and second layers being laminated to each other; b) a rear transparent panel; layer, the rear transparent panel comprising third and fourth film layers, the third and fourth layers being laminated to each other. The front and rear transparent layers are joined together to define an interior compartment, the interior compartment having a top opening; and d) a flap for closing the top opening of the interior compartment. One example of a handbag (10) that can be made in accordance with the present invention is shown in FIG. 1.

As described above, the sealed textile article is described primarily herein as being used to construct a handbag. However, it should be understood that the sealed textile article of this invention can be used to construct a wide variety of articles. To manufacture a handbag, a front, transparent panel is formed by pressing, under heat and pressure, first and second plastic film layers such that the heated plastic material seals the pressed flower(s) and fixes the pressed flower in position. Likewise, the rear, transparent panel is formed by pressing, under heat and pressure, third and fourth plastic film layers such that the heated plastic material seals the pressed flower(s) and fixes the pressed flower in position. Any suitable material can be used to make plastic film layers including, but not limited to, polyethylene, ethylene-ethyl acrylate copolymer, ethylene-vinyl acetate copolymer, ethylene-acrylic acid copolymer, and ethylene-methacrylic acid copolymer.

The first and second transparent panels are joined together to define an interior compartment for the handbag (10). The flap is attached to one of the transparent panels and fastened to the opposing transparent panel when the flap is closed. For example, the flap can be attached to the rear transparent panel, and the flap can be releasably fastened to the front transparent panel when the handbag is closed. In another example, the flap can be attached to the front transparent panel, and the flap can be releasably fastened to the rear transparent panel when the handbag is closed. It is important that the fastening mechanism does not damage the integrity of the flowers. Different fastening systems, for example, buttons, snap fasteners, laces, Velcro® hook and loop fasteners, buttons/button-holes, buckles, and the like can be used for removably fastening the first and second transparent panels to each other.

Figure 3:
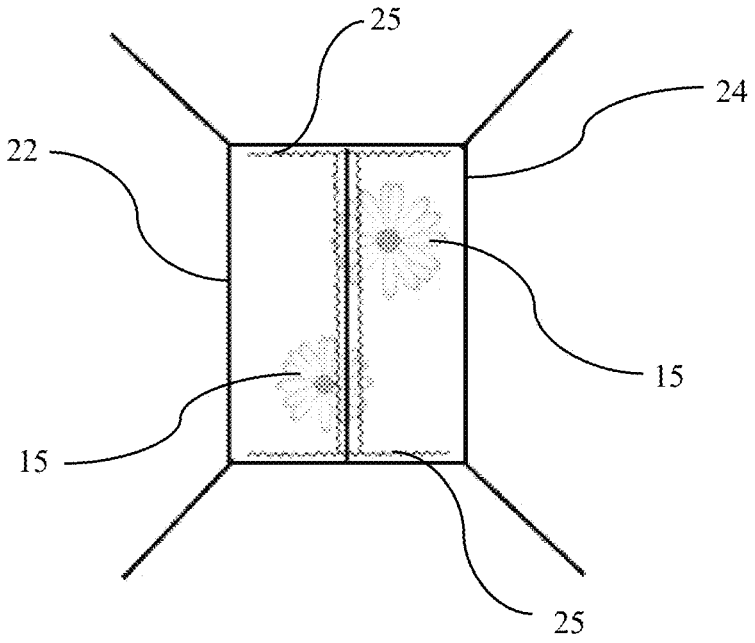
FIG. 3 is a top view of one embodiment of a transparent sealed textile article made in accordance with the present invention, wherein a zipper is shown.
Figure 4:
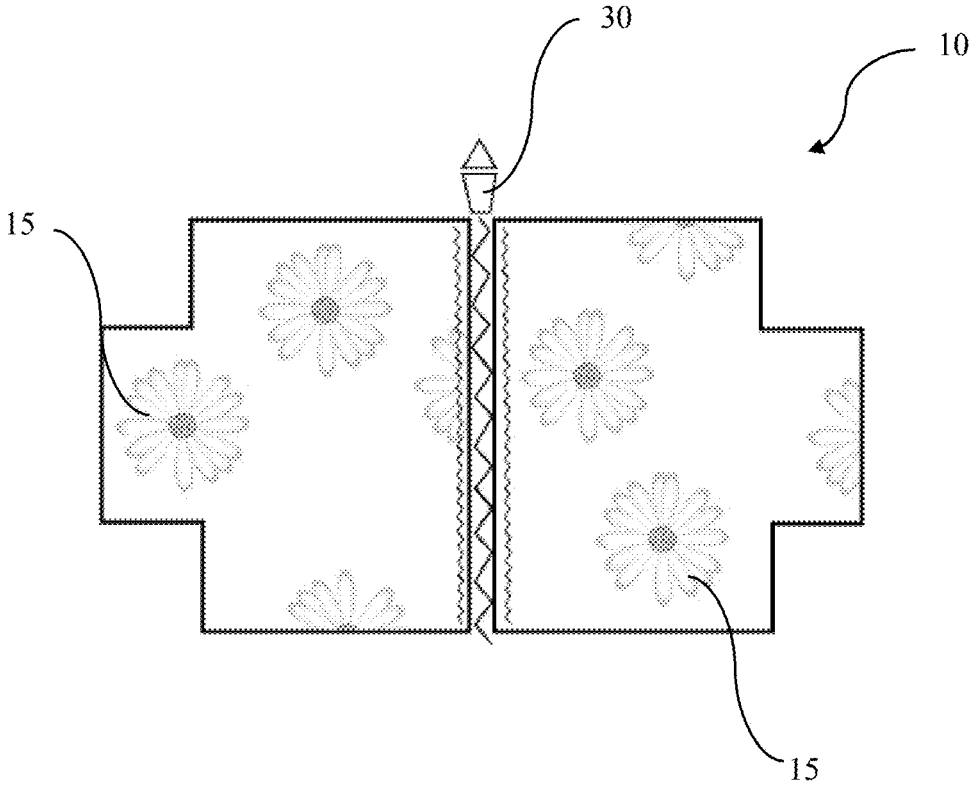
FIG. 4 is a top view of one embodiment of a transparent sealed textile article made in accordance with the present invention, wherein the transparent panels are sealed to each other through stitch lines.

As shown in FIGS. 3 and 4, the front (22) and rear (24) transparent panels of the handbag (10) can be joined to one another through a series of stitch lines (25). The stitch lines (25) may partially define, or provide borders between, the front (22) and rear (24) transparent panels. In another embodiment, a traditional zipper (30) may be used in the handbag construction. The zipper (30) includes the first and second sets of complementary zipper teeth for fastening the front (22) and rear (24) transparent panel members. The panel members (22, 24) are joined and held together by the zipper (30). In this manner, the handbag (10) can be opened and closed to access or cover the interior compartment as desired.

The person carrying the handbag can use one hand to grasp the flap and pull it over the opening. Then, the flap is fastened to the opposing panel to tighten and secure the flap. Snap buttons can be used to lock the flap in place. More particularly, the flap has an outer surface and interior surface. When the flap is pulled over the opening, it is releasably attached to the opposing panel by the snap buttons or other fastening mechanism. The person carrying the handbag may open the flap by simply pulling on it in an upward direction. It is recognized that other closure systems, for example, buttons, snap fasteners, laces, Velcro® hook and loop fasteners, buttons/button-holes, buckles, and the like, can be used.

Process for Manufacturing Sealed Textile Article

In one embodiment of the process of the present invention for manufacturing the sealed textile article, the process comprises the steps of: a) selecting and pressing flowers in a flower press; b) removing the flowers from the press and preparing them for placement on transparent plastic film layers; c) preparing the transparent plastic film layers; c) laminating the transparent plastic film layers together to form transparent panel members (plastic sheets), wherein the flowers are contained between the sealed plastic film layers; d) sewing the transparent panel members (plastic sheets) together; e) turning the transparent panel members (plastic sheets) inside-out so that the stitching lines are on the inside surface of the handbag; and f) preparing the finished piece. The steps of the process are described in further detail below.

In Step a), the flowers are selected and pressed. The flowers can be chosen and pressed on industrial style plant presses to produce a specimen that is prepared for the textile making process. Floral types that can be implemented in our textiles are preferably under 2 mm for the correct seal within the vinyl for accessory making.

Figure 5:
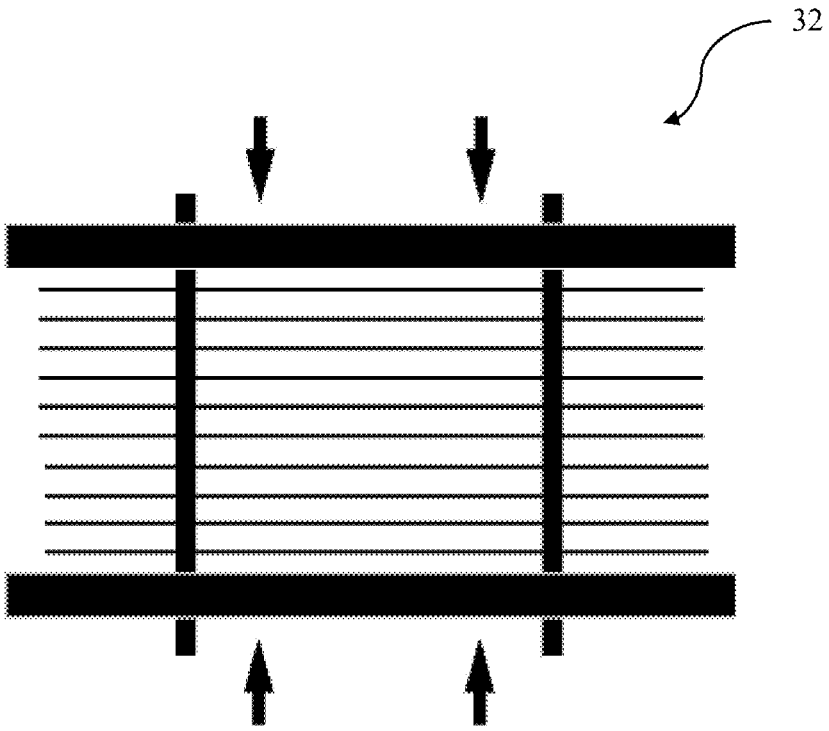
FIG. 5 is a side view of one embodiment of a flower press that can be used in the present invention to make the transparent sealed textile articles.

One example of a flower press (32) for pressing the flowers is shown in FIG. 5. The florals must be dry but not brittle, retaining color and having a relatively low level of moisture so they are flexible but not prone to molding once sealed. If the moisture level is too high, mold will grow on the organic material and ruin the integrity of the bag. The time-period needed for pressing the flowers should be sufficient to reduce the moisture content of the flowers to an acceptable level. The time required on the flower press is determined by extensive testing and moisture of organic contents at the time of pressing (for example, tulips need more time than daisies.) Any suitable flower press can be used to press the flowers sufficiently. In one example, a high-quality herbarium grade press is used.

Flowers with large and thick centers or discs (such as sunflowers) cannot be pressed and used for the textile making process. The selection of flowers is of utmost importance, additionally the end-result of flower pressing is decided by the color and variety of the flower and determines the aesthetic outcome and integrity of the accessory which is part of the decision-making process.

In Step b), the flowers are removed from the flower press (32) and prepared for placement on a plastic film layer. The flowers are removed in batches from the press once they preferably reach about 5 to about 10% moisture content (depending on flower type). At the moisture content of about 5 to about 10%, the flowers are substantially dry for purposes of the present invention. The flowers are then removed carefully with tweezers and placed in batches as determined by the type of flower. The flowers are tested by bending and making the moisture content calculation upon press removal. The moisture content is determined by the following formula: Moisture content %=Fresh Mass/Dried Mass× 100). This process allows for consistency of flower type in each accessory and a correct seal by regulating the thickness across the textile. The flowers are then preferably sprayed with an ultraviolet (UV)-resistant coating to prolong their life and integrity.

Figure 6:
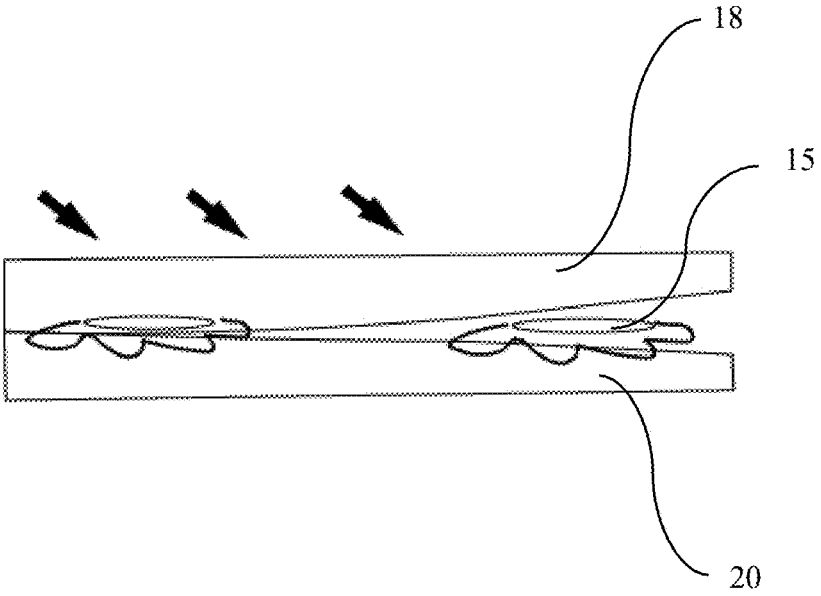
FIG. 6 is a side view of one embodiment of a transparent plastic sheet comprising first and second transparent film layers being made for the sealed textile article in accordance with the present invention.

Referring to FIG. 6, in Step c), a transparent plastic panel member (final plastic sheet) comprising the first and second transparent plastic film layers (18, 20) with the flowers (15) disposed between the film layers (18, 20) is prepared. Patterned pieces of 24 gauge (or 0.5 mm) individual pieces) of glossy vinyl film are cut to sizes to construct the various accessories. Thus, the process of constructing a wearable accessory begins. The film material must be dust-free so that there can be a quality-seal between the two film layers. When sealed together, the transparent film layers comprise the final plastic panel (sheet) containing the flowers (15). Preferably, the final plastic film sheet comprising the two film layers measures about 1 mm in total thickness.

As discussed above, the dried, pressed flowers (preferably of a single type and thickness) are placed onto a single transparent plastic film layer (upper or lower) in a loose pattern (with an estimated distance of about 2-3 inches between each flower). In other embodiments, the dried, pressed flowers can be placed on both transparent plastic film layers (upper and lower). The positioning of the flowers needs to be single-layered for a correct seal and are given space between each one in order to guarantee proper placement in the next step. Additionally, gold leaf can be added as sheets between the sealed film layers (along with the flowers) so that it is essentially sealed inside as well. The gold leaf is used for design purposes in extremely thin layers so as not to interfere with the floral preservation process. The plastic film layers are light-resistant, aging-resistant, and non-yellowing, and the layers pass off these attributes to its organic inserts.

Figure 7:
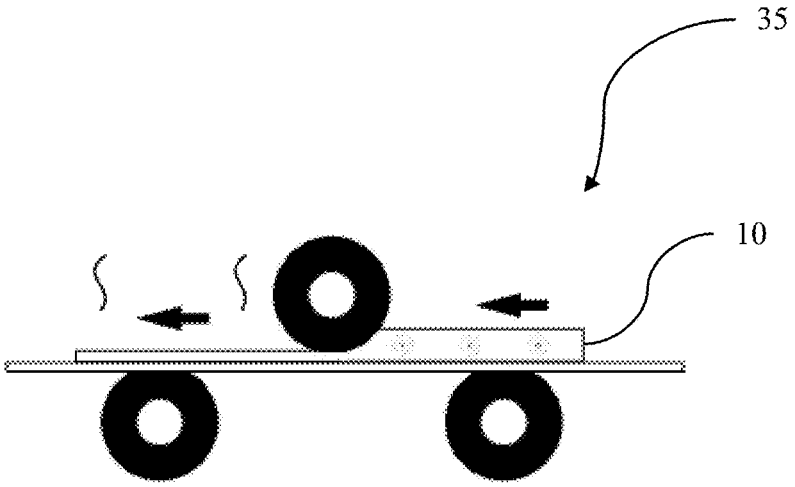
FIG. 7 is a side view of one embodiment of a transparent plastic sheet comprising first and second transparent film layers being laminated for making the sealed textile article in accordance with the present invention.

In Step d), the first transparent plastic film layer (18), and second transparent plastic film layer (20) are fed through a heated roller lamination machine (35) as shown in FIG. 7. This laminating process will form the transparent plastic panel member (final sheet) comprising the first plastic film layer (18), and second plastic film layer (20). This laminating process is done panel-by-panel for each pattern—the laminator is preferably set to 293 degrees Fahrenheit (293° F.). The plastic film layers (18, 20) need to be put through the machine on a layer of manila cardstock which is larger than the panel. The plastic film layers (18, 20) need to have their edges trimmed perfectly with a blade before inserting to ensure a seal and avoid the damage or peeling back of a single layer while processing in the machine.

The specificity of the temperature is of the utmost importance as if set higher, it will melt the plastic vinyl sheeting and burn the organic material of the flowers. Often causing them to discolor. Additionally, if the heat is too high, it removes the gloss of the plastic vinyl sheeting and ruins the integrity of the material for aesthetic purposes.

The pressure and heat of the laminating machine (35) paired with the proper preparation of the flowers (15) creates a clean bubble-less seal around the flowers as the excess air is pressed out of the textile upon the pressure from lamination. The seal holds the flowers in place and creates structure around the delicate organic form through the reinforcement of the vinyl plastic sheeting on both ends. At this point, both ends of the plastic vinyl sheeting are now tightly and semi-permanently adhered but not melted. The flowers (15) will not move or shake and are resistant to cracking when flexing the fabric.

At this stage, shapes can be created with the fabric with the flowers (15) acting more so as a "built-in" pattern, that is essentially an integral material which acts as one. This is similar to a textile which is woven together. The flowers, vinyl, and gold leaf act as one and can be stored for later assembly or rolled for future use. The flowers (15) should still be stored out of direct sunlight—for this will expedite the process of natural fading.

In Step e), the front (22) and rear (24) transparent panel members (final plastic vinyl sheets) are sewn together. Upon sewing, a machine with a Teflon® foot as well as an industrial or similar like machine (with metal interior parts) should be used to sew through a thicker fabric of this nature. Most patterns involve the sewing together of the two prepared transparent panel members (22, 24) (plastic vinyl film sheets) by lining the edges up properly and sewing the sheets according to the edges to create an overall desired shape and structure. Sewing is done with a zig-zag stitch characterized to create a signature look and desired structure. Additionally, the plastic vinyl sheets should be sewn in a zig-zag pattern to prevent tearing from straight stitches which are too close together.

Upon sewing, excess material should be trimmed from the edges which does not affect vinyl layer sealing—as the seal is consistent throughout the textile not just at the edges). Most patterns are sewn in order to produce interior and functional space and structure which creates a unique and glass-like finish on the final finished product. Stitches are sewn primarily on the interior for a clean and minimal look once complete. Flowers may also be sewn through and will remain in place and in form despite this. The flowers are adhered through this specific process. Due to the temperature-sensitive nature of the vinyl sheet, the material needs to be sewn in a room which is temperature-controlled between about 60 to about 70 degrees Fahrenheit for maximum effect.

In Step f), the turning step takes place. After the pattern sewing is complete and the excess fabric edges and thread are removed the process of "turning" can begin. Each piece is heated by hand with a heat gun ideally in a controlled temperature environment.) It is important for the vinyl to reach a level of softness for turning the piece inside out (so the stitching is inside) to achieve good final form and prevent stress on the delicate flowers. When heating it must be done carefully so as not to melt the fabric, zippers or any elements used in the final piece. If melted the fabric will not have the same integrity or visual appeal.

During this step, the process of turning needs to be completed quickly. Visually the material will indicate by bowing and softening as it heats and stiffening back up after turning and when cooling in its final form. The placement of the flowers is possible within corners, at the zipper or anywhere throughout the textile.

The final sealed textile article should be a durable, water resistant wearable vinyl accessory that can, despite its organic and delicate contents, resist wear and consistent usage. The end look of the transparent sealed textile article is that of glass, with clarity, cleanliness, and visibility of the florals. The textile remains flexible with usage similar to the way fabric should behave making it comfortable and practical to the wearer. The process of the present invention produces transparent sealed textile articles having a glass-like visual appeal. The resulting products of the invention have a distinctive aesthetic look.

It should be understood that the terms, "front", "rear", "first", "second", "third', "fourth", "top", "bottom", "upper", "lower", "upwardly", "downwardly", "above" "below", "right", "left", and the like are arbitrary terms used to refer to one position of an element based on one perspective and should not be construed as limiting the scope of the invention.

It also should be understood that the processes, products, constructions, materials, and the like described and illustrated herein represent only some embodiments of the invention. It is appreciated by those skilled in the art that various changes and additions can be made to the processes, products, constructions, materials, and the like without departing from the spirit and scope of this invention. It is intended that all such embodiments be covered by the appended claims.

I claim:

1. A process for making a sealed textile article containing a pressed flower, comprising i) selecting at least one flower that will be pressed;

ii) pressing the at least one selected flower;

iii) placing the at least one pressed flower on a front surface of a first transparent plastic film layer;

iv) laminating the first transparent plastic film layer to a second transparent plastic film layer to form a front transparent plastic sheet, wherein the at least one pressed flower is disposed between the first and second transparent film layers of the plastic sheet;

v) repeating steps i) through iv) to form a rear transparent plastic sheet;

vi) sewing the front and rear transparent plastic sheets together to form a sealed textile article, wherein a stitch line is formed on an exterior surface of the article; and vii) turning the sealed textile article so that the stitch line is located on the inside of the article and is not visible on the exterior surface.

2. The process of claim 1, wherein the sealed textile article is a wearable accessory.

3. The process of claim 1, wherein multiple flowers are selected.

4. The process of claim 3, wherein the pressed flowers have a moisture content in the range of about 5 to about 10 percent.

5. The process of claim 4, wherein the pressed flowers are sprayed with an ultraviolet (UV) light-resistant coating.

6. The process of claim 3, wherein the pressed flowers are placed on the front surface of the first transparent plastic film layer with gold leaf.

7. The process of claim 3, wherein the first plastic film layer is laminated to the second plastic film layer under pressure at a temperature in the range of about 280° to about 310° F.

8. The process of claim 3, wherein the thickness of each of the front and rear transparent plastic sheets is about 2 mm.

9. The process of claim 3, wherein the stitch line is formed in a zig-zag pattern.

10. The process of claim 1, wherein the first and second plastic film layers are made from a material selected from the group consisting of polyethylene, ethylene-ethyl acrylate copolymer, ethylene-vinyl acetate copolymer, ethylene-acrylic acid copolymer, and ethylene-methacrylic acid copolymer; and combinations thereof.

11. The process of claim 1, wherein the sealed textile article is a handbag, wherein the front and rear transparent plastic sheets define an interior compartment, the interior compartment having a top opening.

12. The process of claim 11, wherein a flap covers the top opening of the interior compartment.

13. The process of claim 11, wherein a zipper covers the top opening of the interior compartment.

14. The process of claim 11, wherein the handbag is a purse.

15. The process of claim 11, wherein the handbag is a clutch bag.

* * * * *